United States Patent [19]

Oliver

[11] 4,147,001

[45] Apr. 3, 1979

[54] CONNECTOR FOR WALL PANEL STRUCTURE

[76] Inventor: Wayne H. Oliver, 1305 Spring Valley Rd. North, Minneapolis, Minn. 55422

[21] Appl. No.: 849,104

[22] Filed: Nov. 7, 1977

[51] Int. Cl.[2] ..... E04B 1/08; E04C 1/10

[52] U.S. Cl. ..... 52/284; 52/233; 52/285; 52/580; 52/584

[58] Field of Search ..... 52/284, 285, 286, 580, 52/584, 233

[56] References Cited

U.S. PATENT DOCUMENTS

| | | | |
|---|---|---|---|
| 695,677 | 3/1902 | Faris | 217/65 |
| 864,801 | 9/1907 | Richards | 52/284 |
| 1,418,257 | 5/1922 | Hay | 52/285 |
| 1,648,591 | 11/1927 | Repay | 217/65 |
| 1,655,662 | 1/1928 | Repay | 36/4 |
| 1,882,678 | 10/1932 | Thum | 211/51 |
| 1,883,214 | 10/1932 | Wilson et al. | 428/33 |
| 2,458,074 | 1/1949 | Hill | 52/285 |
| 2,497,657 | 2/1950 | Cole | 46/31 |
| 2,509,732 | 5/1950 | Ernestus | 52/668 X |
| 2,611,460 | 9/1952 | Nash | 403/382 |
| 2,832,100 | 4/1958 | Swallert | 46/21 |
| 3,051,277 | 8/1962 | Day, Jr. | 52/270 X |
| 3,066,436 | 12/1962 | Schuh | 46/30 |
| 3,070,646 | 12/1962 | Lindgren | 52/277 X |
| 3,133,326 | 5/1964 | Budny | 52/288 |
| 3,239,986 | 3/1966 | Russell | 52/580 X |
| 3,279,140 | 10/1966 | Oliver | 52/584 |
| 3,301,149 | 1/1967 | Box | 52/580 X |
| 3,375,631 | 4/1968 | Oliver | 52/584 |
| 3,521,420 | 7/1970 | Oliver | 52/584 |
| 3,552,079 | 1/1971 | Mortensen | 52/593 |
| 3,559,356 | 2/1971 | Koral | 52/254 |
| 3,662,507 | 5/1972 | Espeland | 52/220 |
| 3,820,294 | 6/1974 | Parker | 52/262 |
| 3,919,819 | 11/1975 | Oliver | 52/584 |
| 3,994,105 | 11/1976 | Jamison et al. | 52/285 |
| 4,008,553 | 2/1977 | Oliver | 52/584 |

FOREIGN PATENT DOCUMENTS 477844 10/1969 Switzerland.

*Primary Examiner*—Alfred C. Perham

*Attorney, Agent, or Firm*—Merchant, Gould, Smith, Edell, Welter & Schmidt

[57] ABSTRACT

Self-locking connector elements at opposite ends of elongated panels for interlocking superposed panels with others at angles thereto, to provide wall structure for enclosures of various types. The connector elements each have a pair of laterally spaced side wall portions connected at one end by a transverse wall portion and a partition connection the side wall portions in spaced parallel relation to the transverse wall portion. The side wall portions are secured to an end of a given panel, parallel to opposite sides of the panel, with the transverse wall portion and partition disposed in longitudinally outwardly spaced relation to the adjacent end of the panel, the partition and wall portions forming an open ended passageway. The side and transverse wall portions of each connector element have slots extending from one end of the wall portion toward the opposite end, some of these slots being positioned to receive slotted portions of a connector element on the end of another panel disposed at right angles to the given panel. The partitions extend the full length of their respective connectors and have openings linable with other openings in side wall portions of the connector elements of other panels for reception of locking members.

2 Claims, 6 Drawing Figures

FIG. 3
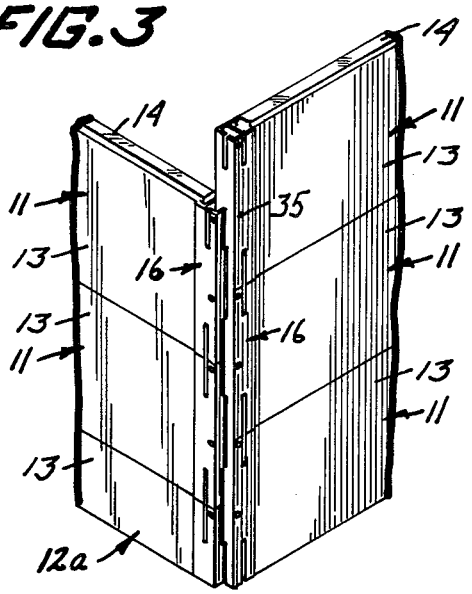
FIG. 4
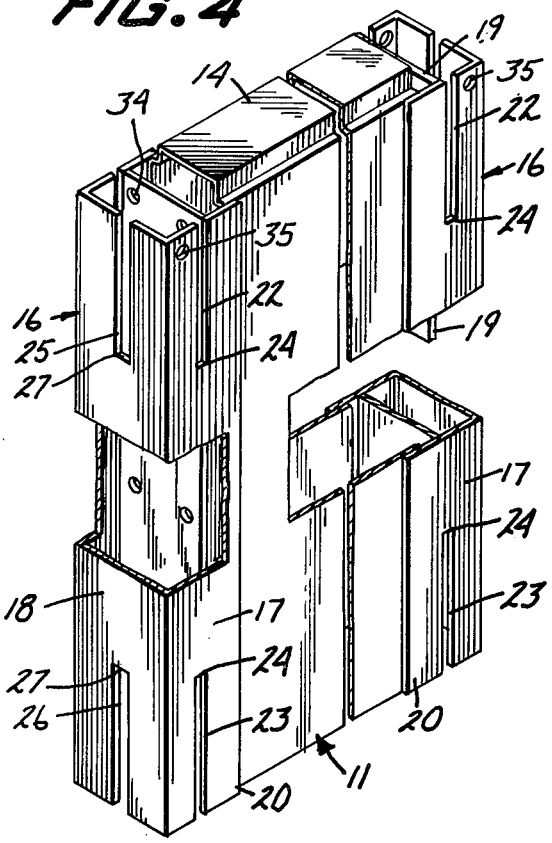
FIG. 5
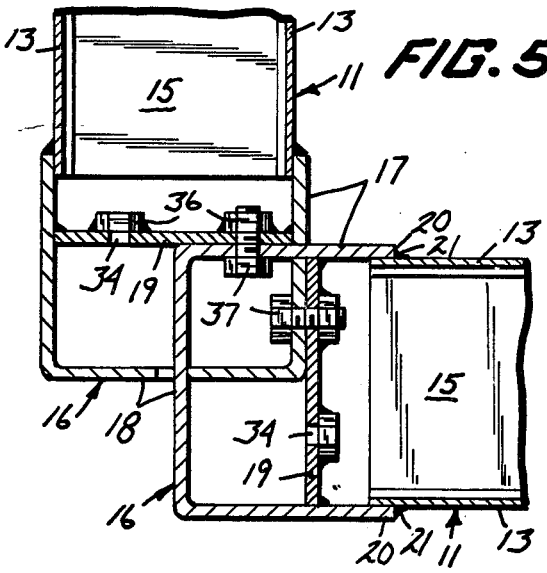
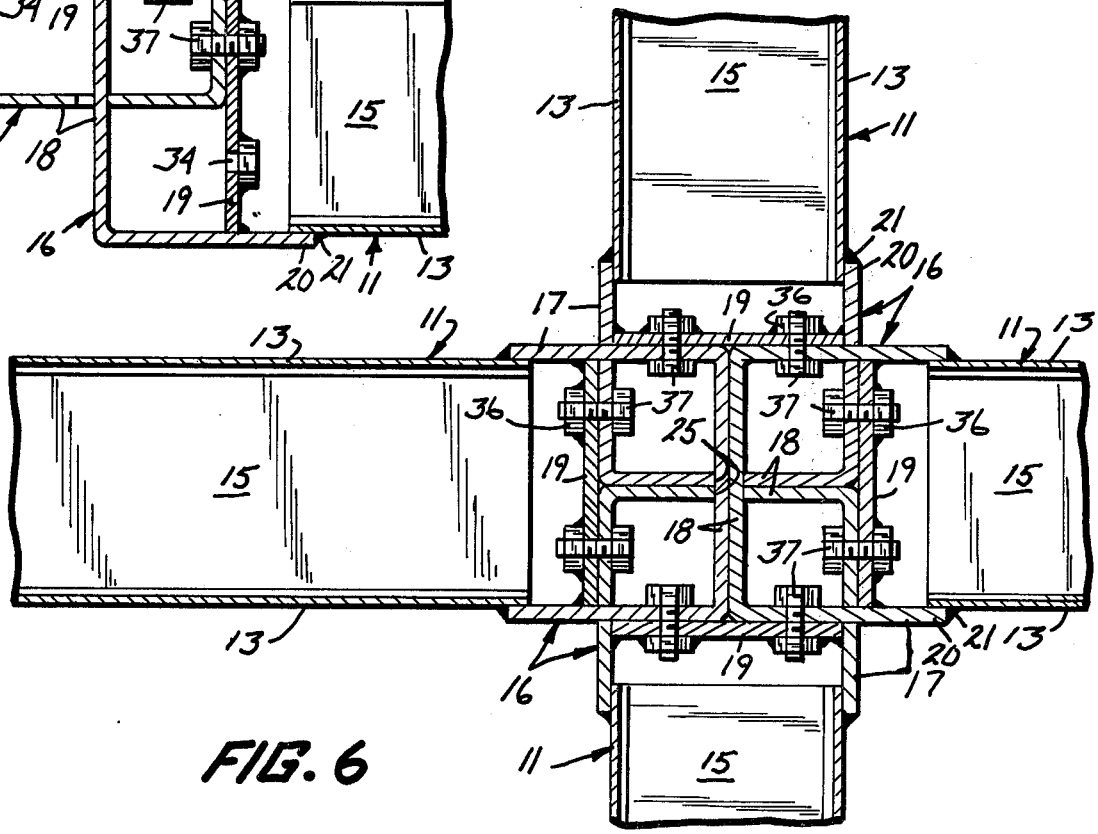
FIG. 6

CONNECTOR FOR WALL PANEL STRUCTURE

BACKGROUND OF THE INVENTION

This invention relates generally to panel construction used in the erecting of wall structure for enclosures such as storage bins, and is in the nature of an improvement over panel connector elements of the type disclosed and claimed in my prior U.S. Pat. Nos. 3,919,819 and 4,008,553.

It has been found that the types of connector elements disclosed particularly in U.S. Pat. No. 3,919,819 have tended to bend laterally under pressure of extremely heavy loads of granular material, when such heavy granular material is placed in bins of the disclosed type to a considerable depth.

Further, it has been found advantageous not only to lock adjacent panels against vertical movement relative to each other when it is desired to provide a permanent wall structure, but also to prevent any slight lateral movement which might occur between adjacent panels due to dimensional tolerances in the interfitting connector elements thereof.

Reference is further had to my prior U.S. Pat. Nos. 3,279,140; 3,375,631 and 3,521,420; all of which disclose bin panel constructions having other different types of connector elements associated therewith.

SUMMARY OF THE INVENTION

In the present invention, a plurality of generally rectangular wall panels each have spaced parallel side wall surfaces, opposed top and bottom surfaces, opposite vertically extended ends, and self-locking connector elements at said opposite ends. Each of said connector elements extends substantially the full vertical length of its respective panel and comprises laterally spaced generally flat side wall portions, an outer generally flat transverse wall portion connecting said side wall portions, and a partition connecting said side wall portions in inwardly spaced parallel relationship to said outer transverse wall portion; said side wall portions projecting outwardly from the panel ends and planes parallel to the planes of said panel side wall surfaces and being rigidly connected to the panel side wall surfaces. The side wall portions, transverse wall portions and partition of each connector element cooperating to define an open ended passageway and having opposite ends adjacent respective ones of said top and bottom surfaces of the panel. The transverse wall portion and at least one of said side wall portions of each connector element each has a pair of aligned longitudinal slots extending from opposite ends of their respective connector element longitudinally of the passageway defined thereby; each slot having a bottom disposed in spaced parallel relationship to the bottom of the slot aligned therewith. Slots of the transverse wall portion and one side wall portion of each connector element are arranged to receive the transverse wall portion and one of the side wall portions of another connector element beyond the bottom of the slots thereof, when said panels are moved into interlocking relationship at generally right angles to each other, the slots in said side wall portion of each connector element being disposed along one side of their respective partition.

BRIEF DESCRIPTION OF THE DRAWINGS

FIG. 3 is a fragmentary view in perspective showing an exterior corner portion of a wall, on a reduced scale;

FIG. 4 is a fragmentary view in perspective of a wall panel and connector element of this invention, some parts being broken away and some parts being shown in section;

FIG. 5 is an enlarged fragmentary section taken on the line 5—5 of FIG. 2; and

FIG. 6 is a view corresponding to FIG. 5, but showing a plurality of wall panels joined together to provide a juncture of four walls.

DETAILED DESCRIPTION OF THE PREFERRED EMBODIMENT

Figure 1:
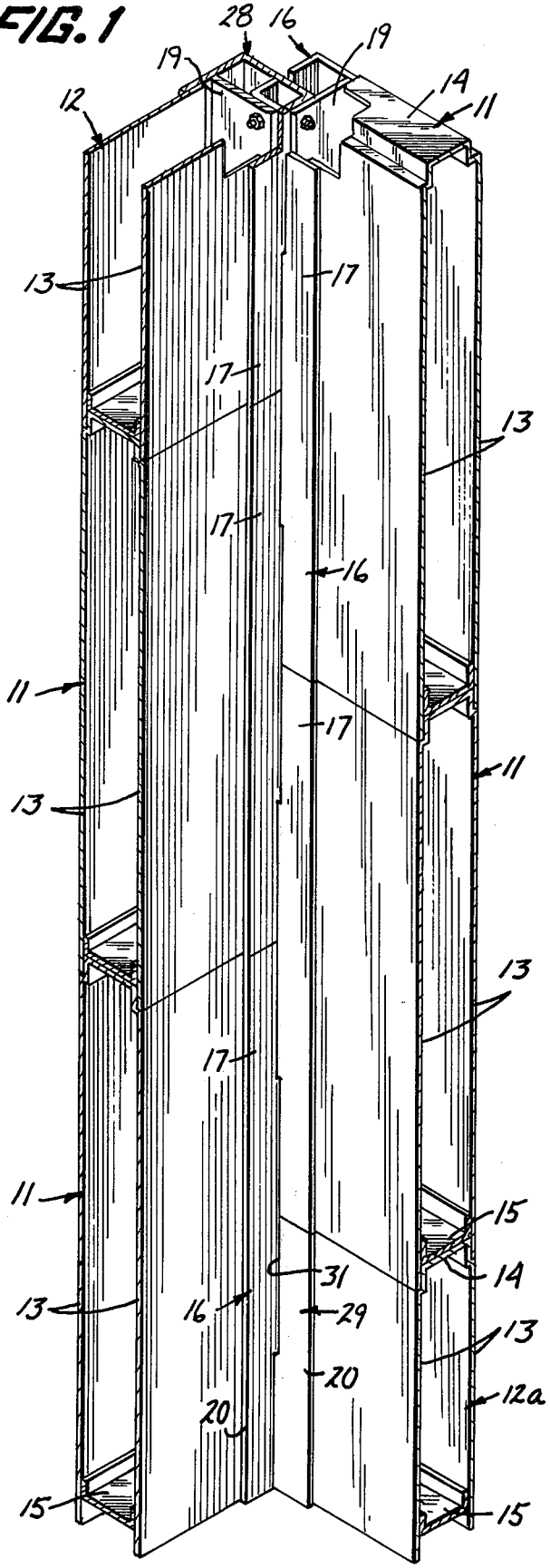
FIG. 1 is a fragmentary view partly in perspective and partly in section, showing a pair of vertical walls comprising the wall panels and connectors of this invention joined together to define an interior corner portion of the wall.
Figure 2:
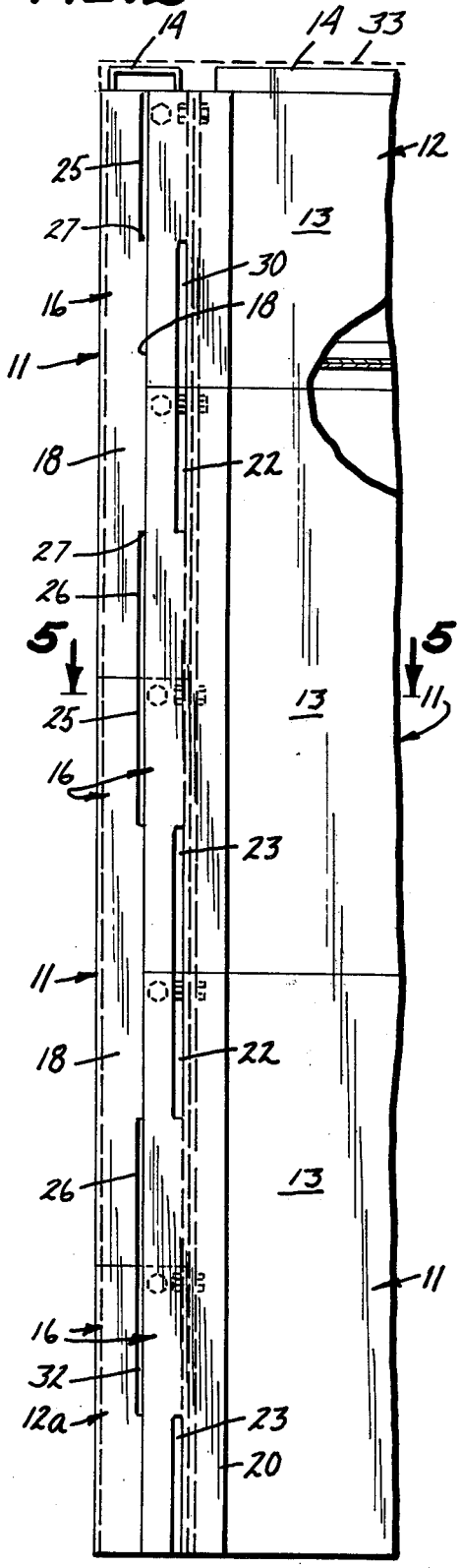
FIG. 2 is a view in side elevation of the exterior corner portion of the wall.

In the arrangement illustrated in FIGS. 1–5, a pair of adjoining wall structures are fragmentarily shown, these comprising a plurality of wall panels 11, 12 and 12a. The panels 12 are similar to the panels 11 except that the panels 12 are one-half the vertical dimension of that of the panels 11. Each panel 11 comprises a pair of laterally spaced parallel side walls 13 and top and bottom walls 14 and 15 respectively. Preferably, and as shown, the panels 11 and 12 are formed from flat sheet metal to form the top walls 14, the width of the top walls 14 being substantially equal to, or slightly less than, the spacing between the side walls 13. The bottom walls 15 are generally U-shaped in cross section, and welded or otherwise rigidly secured to the interior surfaces of the side walls 13 slightly above the lower edges thereof, so that the bottom walls 15 and the lower edge portions of the side walls 13 define downwardly opening channels for reception of the upper edge portions of underlying panels 11 and 12, as shown particularly in FIG. 1. With this arrangement, the bottom walls 15 rest on the top walls 14 of underlying panels 11 or 12. Each panel 11 is provided at its opposite ends with a pair of like connector elements indicated generally at 16, each connector element being cross sectionally generally U-shaped and having side wall portions 17, transverse wall portions 18 connecting the side wall portions 17 and partitions 19. The partitions 19 are welded or otherwise rigidly secured to the inner surfaces of the side wall portions 17 in inwardly spaced parallel relationship to the transverse wall portions 18. The side wall portions 17 of the connector elements 16 are disposed in parallel relationship to the panel side walls 13, and have outer edge portions 20 that overlap the adjacent ends of the panel side walls 13 and are welded or otherwise rigidly secured thereto, as indicated at 21, see particularly FIG. 5. The partitions 19 cooperate with their respective side and transverse wall portions 17 and 18 respectively to define open ended passageways 22 that extend longitudinally for the full length of the connector elements 16.

Each of the side wall portions 17 is formed to define a pair of aligned upper and lower elongated notches or slots 22 and 23 respectively, the slots 22 opening upwardly to the upper end of their respective connector elements 16, and the slots 23 opening downwardly at the lower ends of their respective connector elements 16. Each of the slots 22 and 23 has an inner end or bottom 24, the bottoms 14 of aligned pairs of slots 22 and 23 being spaced apart a distance equal to one-half of the vertical dimension of their respective panels 11, or one-half the distance between the top and bottom surfaces defined by the walls 14 and 15 thereof. Similarly, the transverse wall portion 18 of each connector element 16 is formed to provide a pair of longitudinally extending aligned upper and lower notches or slots 25 and 26 respectively that have inner ends or bottoms 27 that are level with the bottoms 24 of the slots 22 and 23 respectively. With reference particularly to FIG. 4, it will be seen that the slots 25 and 26 are substantially twice as wide as the slots 22 and 23. The slots 22 and 23 are slightly greater than the thickness of the wall portions 17 and 18, the slots 25 and 26 having a width to accomodate a double thickness of the wall portions 17 and 18.

The panels 12 and 12*a* are similar in construction to the panels 13, but are one-half the height of the panels 13, the panels 12*a* being used as the bottom panel in alternate walls, the panels 12 being used as the top panels in alternating walls. Both the panels 12 and 12*a* have side walls 13, top and bottom walls 14 and 15 respectively, and opposite end connector elements 28 and 29 respectively. The connector elements 28 have downwardly opening notches or slots 30 in the side wall portions thereof, substantially identical to the notches or slots 23, and downwardly opening slots, not shown, but in the outer end walls thereof substantially identical to the downwardly opening slots 26. In like manner, the connector elements 29 have upwardly opening slots 31 in the side walls thereof, substantially identical to the slots 22, and upwardly opening slots 32 substantially identical to the slots 25.

The various panels 11, 12 and 12*a* are used to build rectangular wall structures, such as are used in storage bins and the like, in the manner set forth in my prior U.S. Pat. No. 3,919,819. The corners of the wall structure are joined as shown in FIGS. 1–3 and 5. In erecting a wall structure having partitions therein, partitions are joined together as shown in FIG. 6. By omitting one tier of panels from the structure of FIG. 6, two aligned panels may be assumed to comprise a portion of an outside wall of the bin structure, while the third panel, normal to said two panels may be considered as a partition wall panel. Such an arrangement is shown in FIGS. 6–8 of the drawings of prior U.S. Pat. No. 3,919,819. In constructing a bin or other wall structure, a pair of panels 12*a* are first set on the ground or on a foundation in laterally spaced parallel relationship. A panel 11 is then connected at its opposite ends to one end of each of the panels 12*a*, and a second panel 11 is connected to the opposite ends of the panels 12*a* to form a rectangular ring. Thereafter, other panels 11 are superimposed on the panels 12*a*, and still other panels are superimposed on the lowermost panels 11 to form a second loop or ring of panels. This procedure is followed with successive rings of panels until the desired height of container is reached. The panels 12 are used at the top ring or loop to provide a top ring in which the top walls 14 are all at a uniform level. If desired, a suitable cover ring or cap, shown by dotted lines in FIG. 2, and indicated at 33, may be used to provide a finished appearance to the top of the wall; or, if desired, a suitable roof, not shown, may be erected over the top of the wall structure.

During erection of the wall structure, above described, in connecting the panels 11 to the panels 12*a*, a notch 23 is aligned with a notch 31, and a notch 26 is aligned with a notch 32, and the panel 11 is lowered into internotched engagement with the panel 12*a*. Thus, the downwardly opening notch or slot 23 receives that portion of the connector element 29 below the notch 31 therein, and the upwardly opening notch 32 receives that portion of the transverse wall 18 above the notch or slot 26 therein. As subsequent tiers are added to the wall structure, lower slots 23 and 26 receive wall portions 17 and 18 respectively below respective upper notches 22 and 25 of the connector elements 16 of underlying panels 11, the inner or bottom ends 24 and 27 of notches 22 and 25 of superimposed panels 13 being disposed in substantially abutting engagement when the top wall 14 of an underlying panel is disposed in abutting engagement with the bottom wall 15 of an overlying panel.

When two wall panels 11 are disposed in end-to-end engagement, with a third wall panel 11 connecting the said two panels, the transverse wall portions 18 of said two panels 11 are received in a single slot 25, as shown in FIG. 6. As therein shown, four panels may be interlocked together to provide an intersection between bin partitions.

With reference particularly to FIGS. 5 and 6, it will be seen that the slots 22 and 23 in the side wall portions 17 have one side in substantially coplanar relationship with an adjacent side of the partition 19. Thus, when a pair of panels 11, 12 or 12*a* are interconnected at right angles to each other, the side wall portion of one connector element is disposed in face-to-face engagement with the partition 19 of the cooperating connector element. Each partition 19, adjacent at least one end and generally centrally between its opposite ends, is provided with a pair of transverse openings 34 therethrough. Likewise, each connector element side wall portion 17, adjacent one end and generally centrally between its opposite ends, is provided with an opening 35, the opening 35 of one panel 11, 12 or 12*a* being aligned with given openings 34 in the partitions 19 of another panel 11 when interlocked therewith. Preferably, the partitions 19 have threaded nut elements 36 welded thereto in alignment with the openings 34 therein for reception of locking screws 37 that are screw threaded into the nuts 36 to positively hold the panels against vertical movement relative to each other. The fastening screws 37 rigidly hold the side wall portions 17 in face-to-face engagement with adjacent partitions 19, to eliminate any transverse movement between adjacent panels which otherwise might occur due to dimensional errors which might occur during manufacture.

The partitions 19 not only serve to more firmly anchor the several panels together, but also reinforce the connector elements to such an extent that the connector elements can be fabricated from fairly light gauge material and yet have sufficient strength to withstand extreme lateral loads against the connector elements for the full length thereof.

While I have shown and described a single embodiment of wall forming panels and self-locking connector means therefor, it will be understood that the same is capable of modification without departure from the spirit and scope of the invention, as defined in the claims.

What is claimed is:

1. In combination, a plurality of generally rectangular wall panels each having spaced parallel side wall surfaces, opposed top and bottom surfaces, opposite vertically extended ends, and self locking connector elements at said opposite ends; each of said connector elements extending substantially the full vertical length of its respective panel and comprising laterally spaced generally flat side wall portions, an outer generally flat transverse wall portion connecting said side wall portions, and a partition substantially coextensive in length with said side wall portions and connecting said side wall portions in inwardly spaced parallel relationship to said outer transverse wall portion; said side wall portions projecting outwardly from the panel ends in planes parallel to the planes of said panel side wall surfaces and rigidly connected to the panel side wall surfaces; said side wall portions, transverse wall portion and partition of each connector element cooperating to define an open ended passageway and having opposite ends adjacent respective ones of said top and bottom surfaces of the panel; said transverse wall portion and at least one of said side wall portions of each connector element each having a pair of aligned longitudinal slots extending from opposite ends of their respective connector element longitudinally of the passageway defined thereby; each slot having a bottom disposed in spaced relationship to the bottom of the slot aligned therewith; slots of the transverse wall portion and one side wall portion of each connector element being arranged to receive the transverse wall portion and one of the side wall portions of another connector element beyond the bottom of the slots thereof when said panels are moved into interlocking relationship at generally right angles to each other; the slots in said side wall portions of each connector element being disposed along one side of their respective partition and having one side in substantially coplanar relationship with one side of its respective partition.

2. The combination defined in claim 1 in which the partitions and at least one side wall portion of each connector element have transverse openings therethrough, the openings in the side wall portion being aligned with given openings in the partitions of connector elements of other panels, when disposed in interlocking relationship, and in further combination with locking members extending through aligned openings in said side wall portions and partitions of adjacent interlocked panels and operable to hold said partitions and adjacent side wall portions in face-to-face engagement.

* * * * *